US005992893A

United States Patent [19]

Watkins

[11] Patent Number: 5,992,893

[45] Date of Patent: Nov. 30, 1999

[54] CONNECTOR

[75] Inventor: Bruce J. Watkins, Houston, Tex.

[73] Assignee: Drill-Quip, Inc., Houston, Tex.

[21] Appl. No.: 08/977,012

[22] Filed: Nov. 24, 1997

Related U.S. Application Data

[63] Continuation-in-part of application No. 08/799,490, Feb. 12, 1997, abandoned.

[51] Int. Cl.[6] ..... F16L 35/00

[52] U.S. Cl. ..... 285/18; 285/124.2; 285/302; 285/309; 285/315; 285/321; 285/334.2; 285/900; 166/89.2

[58] Field of Search ..... 285/124.1, 124.2, 285/121.1, 121.2, 302, 315, 18, 900, 309, 334.2; 166/89.2, 355; 175/321

[56] References Cited

U.S. PATENT DOCUMENTS 4,491,346 1/1985 Walker .
4,496,172 1/1985 Walker .
4,509,777 4/1985 Walker .
4,902,044 2/1990 Williams et al. .
5,309,991 5/1994 Watkins .
5,333,911 8/1994 Watkins .
5,441,311 8/1995 Watkins .
5,634,671 6/1997 Watkins .

FOREIGN PATENT DOCUMENTS 02190714 2/1987 European Pat. Off. ..... 27/12

*Primary Examiner*—Dave W. Arola
*Attorney, Agent, or Firm*—Butler & Binion, L.L.P.

[57] ABSTRACT

There are disclosed two embodiments of a connector for sealably connecting the lower ends of an upper riser member and an upper conduit on the lower ends of an upper riser pipe and upper auxiliary line joint, respectively, to the upper ends of a lower riser member and a lower conduit on the upper ends of a lower riser pipe and upper conduit thereof, respectively. At least one of the conduits includes a telescoping sealed joint which is of such construction as to permit differential movement between the riser and the auxiliary line.

10 Claims, 4 Drawing Sheets

CONNECTOR

This Application is a continuation in part of my application Ser. No. 08/799,490, filed Feb. 12, 1997, and entitled "Connector" and now abandoned.

This invention relates generally to a connector in which the lower end of an upper riser member on the lower end of an upper riser pipe is adapted to be lowered onto the upper end of a lower riser member on the upper end of a lower riser pipe and the two members then locked to one another to hold them in end-to-end relation. More particularly, it relates to improvements in connectors of this type in which the ends of upper and lower conduits connected respectively to the ends of upper and lower joints of one or more auxiliary lines, such as choke and/or kill lines, are carried by and extend along the sides of the riser pipes in position to be moved into telescopically and sealably engaged relation as the upper riser member is lowered onto the lower riser member.

In the drilling or producing of an offshore well from a floating vessel, a riser extends between the vessel and the head of the well. This riser may be as long as several thousand feet, and is made up of successive riser pipes whose adjacent ends are connected on board the vessel, as the riser is lowered into position, or disconnected on board the vessel as the riser is raised. As well-known in the art, auxiliary lines, such as choke and/or kill lines, often extend along the side of the riser to connect with the wellhead, whereby fluids may be circulated downwardly into the wellhead for various purposes.

At one time, it was the practice to lower the riser and auxiliary lines independently of one another. It is the current practice, however, to lower them together, with conduits at the ends of vertically adjacent joints of the lines being carried by the riser members at the ends of the upper and lower riser pipes so as to telescopically and sealably engage one another as the upper riser member is lowered into end-to-end relation with the lower riser member. This requires that the riser members be locked to one another by a connector which does not require rotation of either tubular member.

U.S. Pat. No. 5,441,311, assigned to the assignee of the present application, shows a connector especially well-suited for this purpose. Thus, as shown therein, grooves are formed about the ends of the adjacent riser members and a split ring is carried by the upper tubular member for radial expansion and contraction. When expanded, upper and lower teeth formed about the inner diameter of the ring may be lowered with the ring into positions opposite the upper and lower grooves, and then contracted by cam means about the lock ring into locking engagement with the grooves.

More particularly, a pair of cam rings are disposed about follower surfaces about the lock ring, and bolts carried by plates extending from the riser pipe members connect the cam rings to permit them to be moved toward and away from one another. As illustrated, the lock ring is normally expanded to unlocking position, and the cam rings are moved away from one another to move the locking ring inwardly to locking position.

In prior connectors of this general type, the conduits connected to the adjacent ends of joints of the auxiliary lines are locked against vertical separation through the locking of the riser members to one another. It was found, however, that the force due to the pressure of fluid within the pipes tending to separate them—the "pump-out" effect—created large bending stress in the connector itself. This in turn required manufacturers to build heavier and thus larger and more expensive connectors. In a marine drilling riser for a floating rig, any increase in weight is reflected many times, not only in the cost of the riser, but also in buoyant support material, dynamic support equipment, deck loading requirements, etc.

U.S. Pat. No. 5,634,671, also assigned to the assignee of the present application, discloses a connector in which the joints of the choke and/or kill lines are prevented from vertically separating without materially increasing the weight, size or expense of the connector. Thus, sealably engaged ends of each adjacent pair of choke and/or kill line conduits are locked directly to one another to resist their vertical separation, independently of the locking of the riser members in end-to-end relation. As shown, the conduits are locked against separation by means which comprises first and second lock parts on the upper and lower conduits automatically movable into locking position with respect to one another as the ends of the conduits are moved into sealable engagement, and a third lock part shiftable into a position preventing vertical separation of the first and second lock parts when in locking position.

Although a substantial improvement over the prior art, this later connector does not compensate for the large axial forces imposed on the connector by differential axial movement of the riser and the auxiliary lines. For example, a joint of 21" O.D. drilling riser can stretch 2–3 inches under normal operating conditions. If a high pressure choke and/or kill line is attached to the connector at each end, the tension in the line may impose a force of over a million pounds on the coupling. In addition, the separating force or "pump out" effect due to fluid pressure in the choke and/or kill line conduits can be up to 200,000 pounds each.

An object of this invention is to provide a connector of this type which prevents auxiliary lines from imposing loads on the connector due to differential stretching, temperature expansion, bending, or connector separation.

This and other objects are accomplished, in accordance with the illustrated embodiments of the invention, by a connector which includes, as in prior connectors of this general type, an upper riser member having an upper end adapted to be connected to the lower end of an upper riser pipe, a lower riser member having a lower end adapted to be connected to the upper end of a lower riser member, and means for locking the upper and lower riser members in end-to-end relation. As in prior connectors of the particular type to which this invention applies, it further includes an upper conduit carried by the upper riser member in position to be connected to the lower end of a upper joint of the auxiliary line, and a lower conduit carried by the lower riser member in position to be connected to the upper end of a lower joint of the auxiliary line. However, in accordance with the novel aspects of the present invention, one of the conduits has a first section which has one end sealably engaged with the adjacent end of the other conduit along a first diameter, and a second section having one end telescopically and sealably engaged with the opposite end of the first section along said first diameter. Thus, the axial forces due to pressure of fluid in the line acting on the first and second joints are balanced so that the auxiliary line is free to axially expand and contract without imposing the developed loads on the connector, and thus avoid differential stretching between the riser and auxiliary line which might otherwise load the connector.

In accordance with a second embodiment of the invention, the pressure balanced joint is disposed either above or below each connector, and thus, in any case, intermediate adjacent connectors. Although this represents the most economical approach, there are occasions in which an operator might prefer a pressure balanced joint both above and below the connector. Thus, although this second embodiment is of more expensive construction, it nevertheless compensates for those conditions in which a section of a connector intermediate the balanced joint and an adjacent connector is, for some reason, restrained from free vertical movement. Thus, the riser, which may be 75' in length, may for example, extend through guides in a spar buoy, or, for that matter, clamped along the length, thereby placing undue strain on the connector above and below it. Also, of course, the second balanced joint provides that much more ability for stretch, without the problems attending to long telescoping joints.

As illustrated, and as shown in the aforementioned U.S. Pat. No. 5,441,311, the means for locking the riser members of each connector in end-to-end relation preferably comprises shoulders about the riser members which are tapered toward one another, and a ring for engaging the shoulders to draw them, and thus the ends of the riser members, toward one another. More particularly, the shoulders are formed by locking grooves, and the ring is split and has first and second axially spaced locking teeth on the inner side thereof which are carried by the upper riser member for radial movement between expanded positions in which the second teeth may be moved past the end of the lower riser member to dispose the first and second teeth opposite the first and second grooves, respectively, when said riser members are in end-to-end relation, and contracted positions in which the first and second teeth are interlocked with the first and second grooves, respectively. Also, the means for locking said riser members further includes cam means having shoulders thereabout which are slidable over follower surfaces about the outer side of the ring, and means for moving the cam means axially toward and away from a position to contract the ring into locking position. As also shown in the illustrated and preferred embodiment of the invention, an upper support plate extends laterally of the upper riser member, and a lower support plate extends laterally of the lower riser member, with the upper and lower conduits being mounted, respectively, on the upper and lower plates.

The illustrated embodiments of the invention contemplate an assembly including a pair of such connectors including a upper connector 100A for connecting the lower ends of an upper riser pipe and upper joint of an auxiliary line to the upper ends of an intermediate riser pipe and an intermediate joint, respectively, and a lower connector 100A for connecting the lower ends of the intermediate riser pipe and intermediate joint to the upper ends of a lower riser pipe and a lower joint, respectively. Thus, the upper connector further includes an upper conduit carried by an upper riser member in position to be connected to the lower end of the upper joint of the auxiliary line, and a lower conduit 106A carried by the lower riser member in position to be connected to the upper end of the intermediate joint of the auxiliary line, while the lower connector includes an upper conduit carried by the upper riser member thereof in position to be connected to the lower end of the intermediate joint, and a lower conduit carried by the lower riser member thereof in position to be connected to the upper end of a lower joint of the auxiliary line. More particularly, with the upper and lower riser members of each of the upper and lower connectors locked to one another, the adjacent ends of the section of the and second as well as the adjacent ends of the sections of the upper and lower conduits of the lower connector are telescopically and sealably engaged with respect to one another along a first diameter as above described, and the adjacent ends of the sections of the lower conduit of the upper connector and of the second conduit telescopically and sealably engaged along said first diameter so that the force due to pressure of fluid in the line acting on said adjacent ends is pressure balanced.

In the drawings, wherein like reference characters are used throughout to designate like parts:

Figure 1:
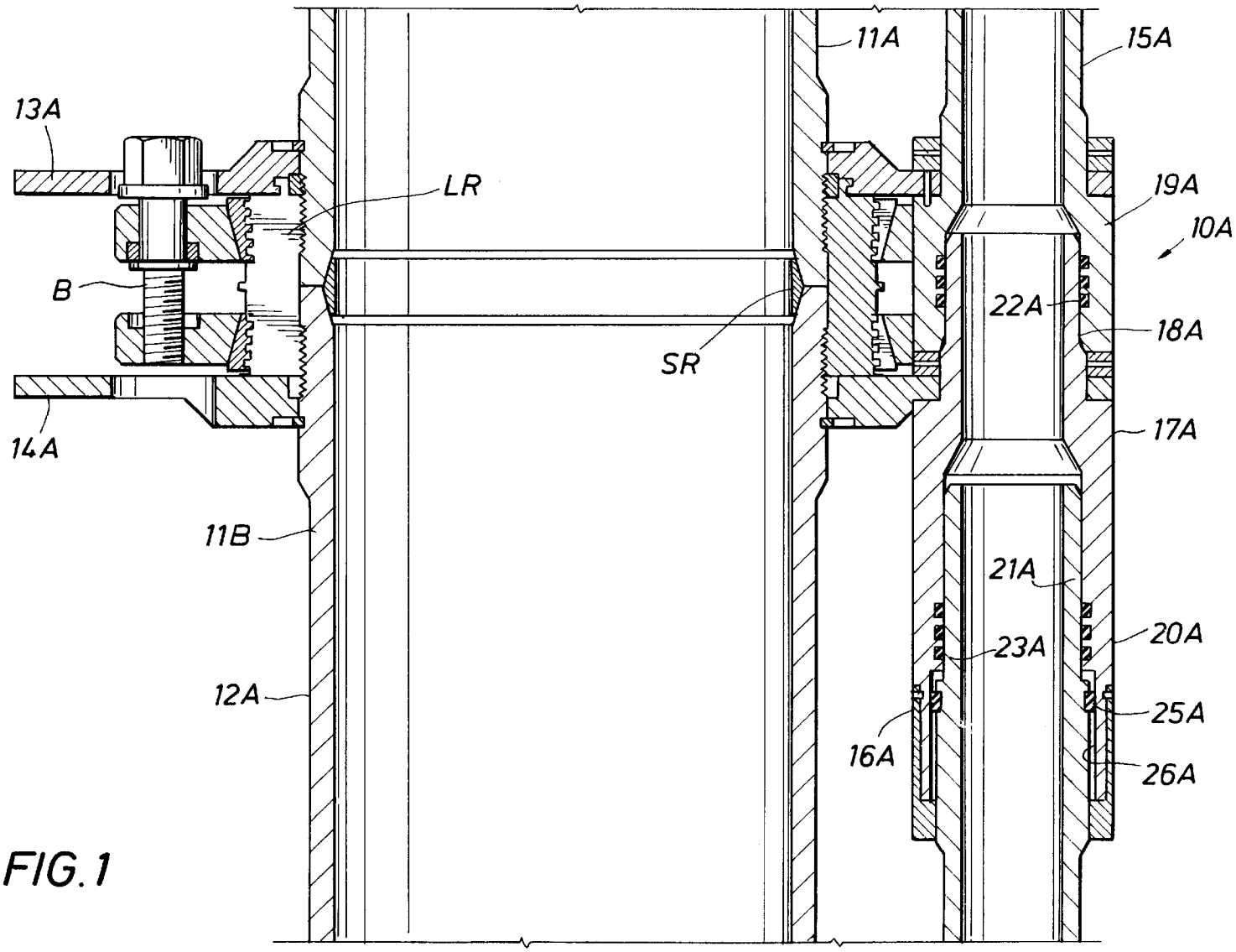
FIGS. 1 and 2 are interrupted vertical sectional views of upper, intermediate and lower portions of a riser pipe and its auxiliary line connected by upper and lower connectors constructed in accordance with the first _____ embodiment of the present invention.
Figure 2:
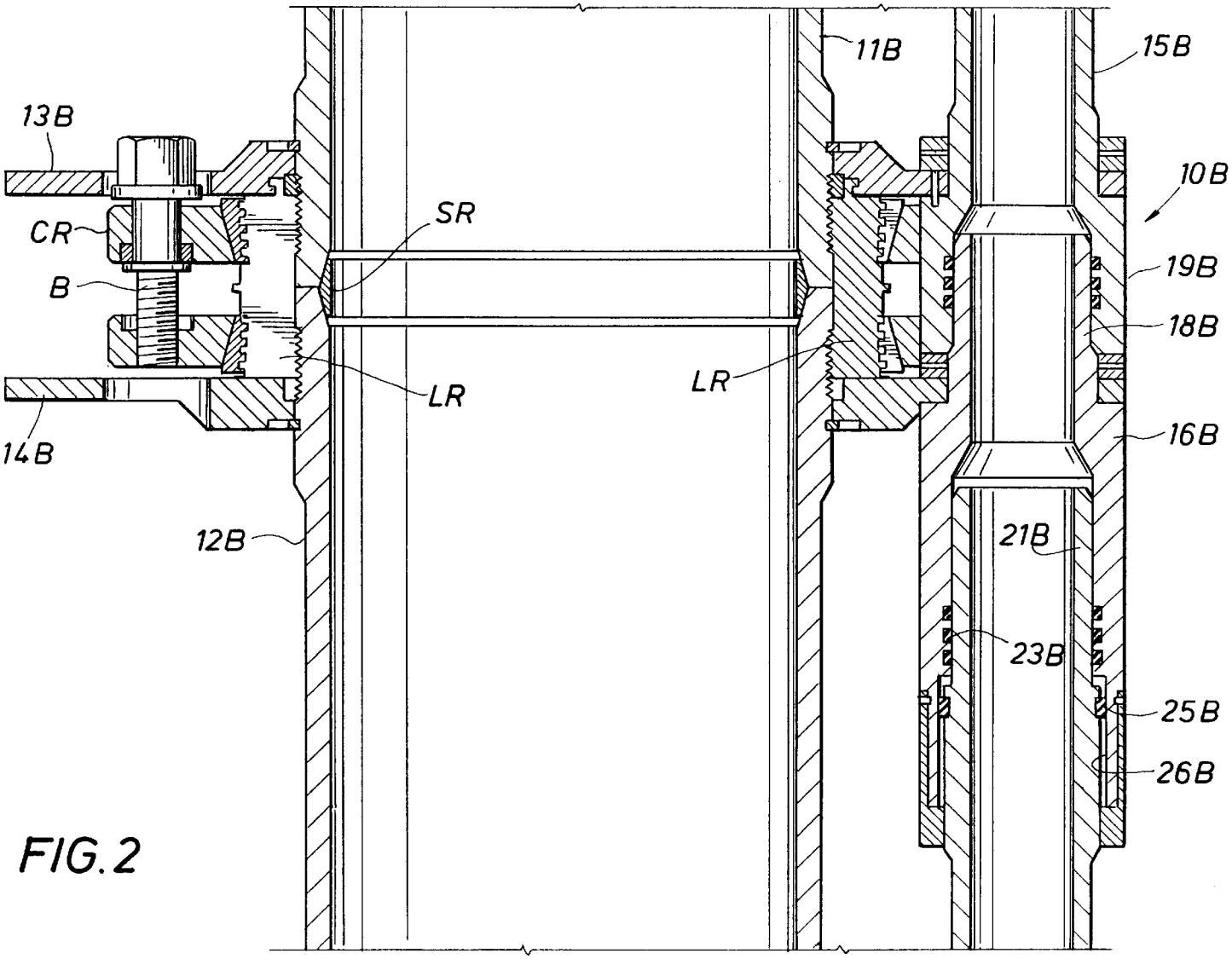

With reference now to the details of the above described drawings, the upper and lower connectors constructed in accordance with the first embodiment, which are shown in FIGS. 1 and 2, and designated in their entirety by reference characters 10A and 10B, respectively, comprise upper and lower riser members 11A and 12A and upper and lower riser members 11B and 12B. The upper and lower riser members 11A and 12A of the upper connector are connected as by welding to the lower end of an upper riser and to the upper end of the intermediate riser pipe, respectively, while the upper and lower riser members 11B and 12B of the lower connector are connected to the lower end of the intermediate riser pipe and the upper end of the lower riser pipe. More particularly, the riser members of each connector are connected in end-to-end relation so as to in turn connect the riser pipes in coaxial relation, and a seal ring SR is sealably engaged between tapered surfaces at the adjacent ends of each riser member to form a smooth continuation of the bore through the connector, and thus through the riser.

A first or upper plate 13A is carried by the upper riser member and a second or lower riser plate 14A is carried by the lower riser member of the upper connector, and upper and lower riser plates 13B and 14B are similarly carried by the upper and lower riser members of the second connector. As shown, these plates extend outwardly from the riser members so as to support conduits connected to the ends of the auxiliary line joints which extend along the sides of the riser pipes. Thus, the lower end of an upper conduit 15A of the upper connector is supported by the upper plate 13A of the upper connector, while the upper end of the lower conduit 16A thereof is supported by the plate 14A of the upper connector.

The lower end of the intermediate conduit 15B is supported by the upper plate 13B of the lower connector 10B in position to be connected as by welding to the upper joint of the auxiliary line, and the upper end of the lower conduit 16B of the lower connector 10B is supported by the plate 14B of the second connector to dispose its lower end in position to be welded to the upper end of the lower joint of the intermediate auxiliary line. More particularly, and as will be described in detail to follow, the adjacent ends of the conduits of each connector are adapted to move into sealed relation as the riser members of the respective connectors are moved into end-to-end relation. As is well known in the art, the auxiliary line may be one of a choke or kill line, and there may be two or more such lines, including both a choke and kill line.

As illustrated, and as shown and described in detail in U.S. Pat. No. 5,441,311, the upper and lower riser members of both connectors may be locked in end-to-end relation, and thus the adjacent ends of the conduits of the auxiliary line held in sealed interfitting relation, by means of a split lock ring LR having upper and lower sets of teeth formed about its inner bore, respectively, and carried by the upper plate thereof for lowering therewith as well as radial movement with respect thereto. As described, the lock ring is carried for radial movement between an expanded position, in which its lower teeth are free to move downwardly over the lower riser member of each connector, and a contracted position, as shown in the drawings, in which the teeth are tightly engaged with matching grooves on the riser members of each coupling. As also described, the surfaces on the teeth and grooves are tapered so as to wedge the teeth tightly into the grooves as the lock ring is moved to locking position, and thus preload the connector by moving the ends of the riser members axially toward one another. Obviously, movement of the lock ring to its outer unlocking position (not shown) enables the riser members to be separated from one another.

As described in the aforementioned patent, the split lock ring is of such construction as to normally assume its expanded or unlocking position, so that it must be forced inwardly to its locking position. For this purpose, conical surfaces are formed about the upper and lower ends of the lock ring and are tapered toward one another. These surfaces are in turn surrounded by upper and lower cam rings CR having similarly tapered surfaces on their inner diameters for sliding over those of the lock ring so as to urge the lock ring inwardly to locking position, as the cam rings are moved inwardly toward one another, and to permit the lock ring to expand its normally assumed outer position when the cam rings are moved toward one another.

As best described in the aforementioned patent, the cam rings are supported and adapted to be moved toward and away from one another by means of bolts B extending between them, with the upper ends of the bolts extending through and mounted on the upper cam ring with their lower ends connected to the lower cam rings by threads. As shown, the heads of the bolts may be manipulated from above the upper plate of each connector in order to move the lower cam ring upwardly or downwardly with respect to the upper cam ring, and thus enable the lock ring to be moved between locking and unlocking position.

As illustrated, the telescoping joint of each connector is located in its lower conduit, and, more particularly, in the case of connector 10A, between the lower conduit 16A and the upper end of the intermediate joint of the auxiliary line, and, in the case of the lower connector 10B, between the lower conduit 16B of the lower connector and the upper end of the lower joint of the auxiliary line. obviously, the telescoping joint of each connector could instead be part of the upper conduit thereof, and for that matter, the telescoping joint could be in the upper conduit of one connection and the lower conduit of another connection, although this would not enable all conduits to be of the same construction. as shown in the drawings.

As shown, each telescoping joint of each connector includes an upper section sealably received in the lower end of the upper conduit, and a lower section sealably received in the lower end of the upper section and having its lower end adapted to be welded to the upper end of the next lower joint of the auxiliary line. More particularly, the upper section 17A of the lower conduit 16A of the connector 10A is sealably received within the lower end 19A of the upper conduit 15A, and a lower section 21A thereof is sealably and slidably received within the lower end of the upper section 17A.

As previously described, the upper end 18A of the section 17A is sealably slidable within seal rings 22A of the lower end 19A of the upper conduit 15A along the same diameter as the upper end of the lower section 21A is sealably slidable within seal rings 23A in the lower end of the upper section 17A. More particularly, the upper section of the lower conduit is fixed in an axial direction with respect to the lower plate 14A, and the lower end 19A of upper conduit 15A is fixed in an axial direction with respect to the upper plate 13A. Consequently, with both plates held against vertical movement with respect to one another, when the connector is in locking position, the upper plate 13A is seated on an upper shoulder of the upper conduit, and held thereon by means of a lock screw, while an upper face of the upper section of the lower conduit is fixedly held against plate 14A by means of a lock screw on the lower plate by seated. Seal rings 22A thus form a static seal between the sections along a first diameter.

The upper section 21A is, however, free to slide vertically with respect to the upper section 17A so as to accommodate differential axial movement between the riser pipe and the auxiliary line. Since the diameters of the seal rings 22A and 23A are of the same diameters, the joint is pressure balanced.

A split ring 25A is mounted on the lower section beneath the seal rings 23A for sliding within a recess 26A formed on the inner diameter of the upper section 17A, thereby preventing separation of the two sections with respect to one another. As shown, the lower end of the upper section 17A may be formed in two parts to permit assembly.

As shown, and as previously described, the lower connector, including the upper and lower conduits thereof, are of identical construction to the upper connector and its upper and lower conduits. Hence, corresponding parts carry the same reference numbers as those of the upper connector except for the substitution of the suffix B for the suffix A. The intermediate conductor is of course connected at its upper and lower ends, respectively, to the lower end of lower section 21A of the upper telescoping joint and the upper end of upper joint 15B of the lower connector.

Figure 3:
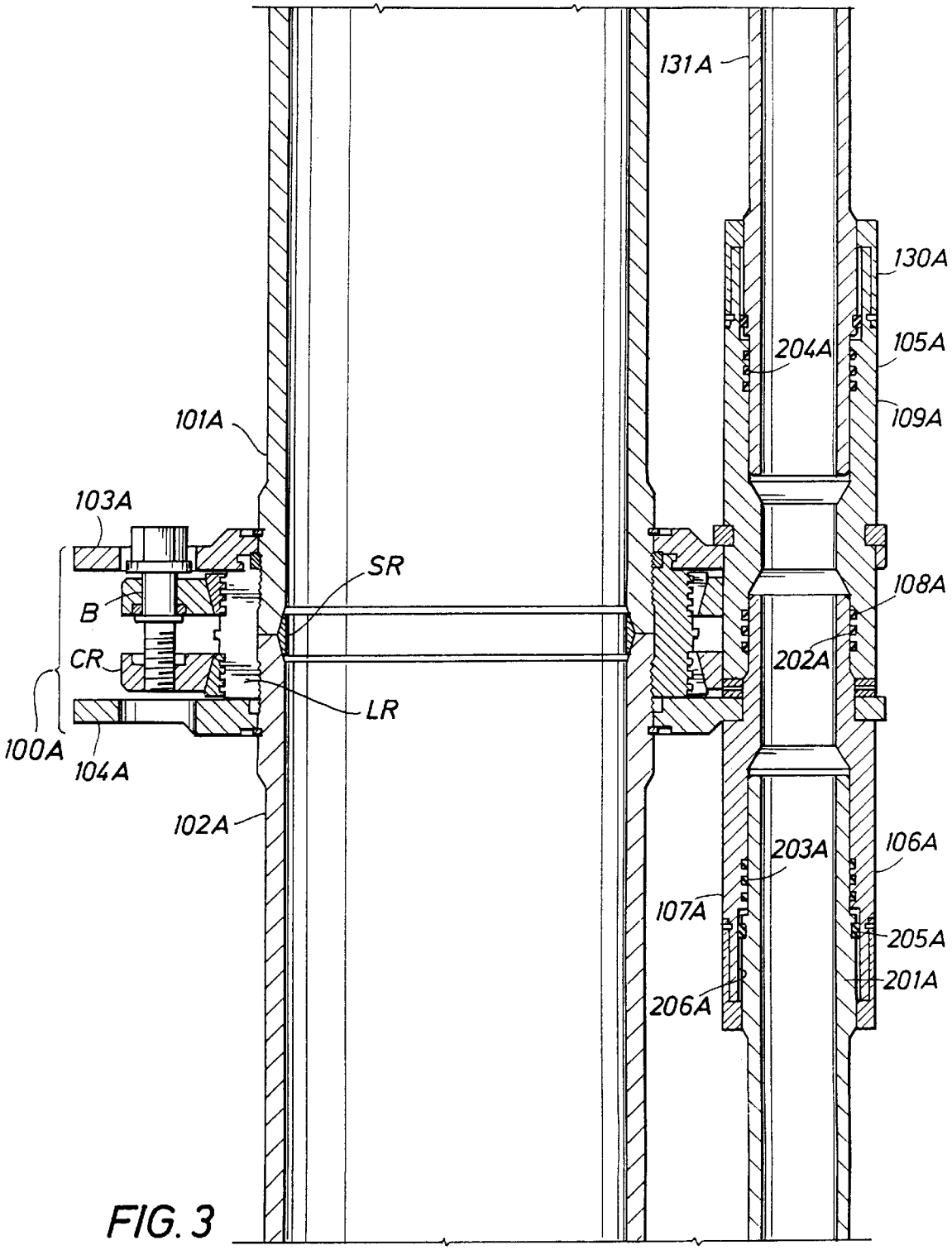
FIGS. 3 and 4 are views similar to FIGS. 1 and of upper, intermediate and lower portions of a riser paper and its auxiliary lines connected by connectors constructed in accordance with the second described embodiment.
Figure 4:
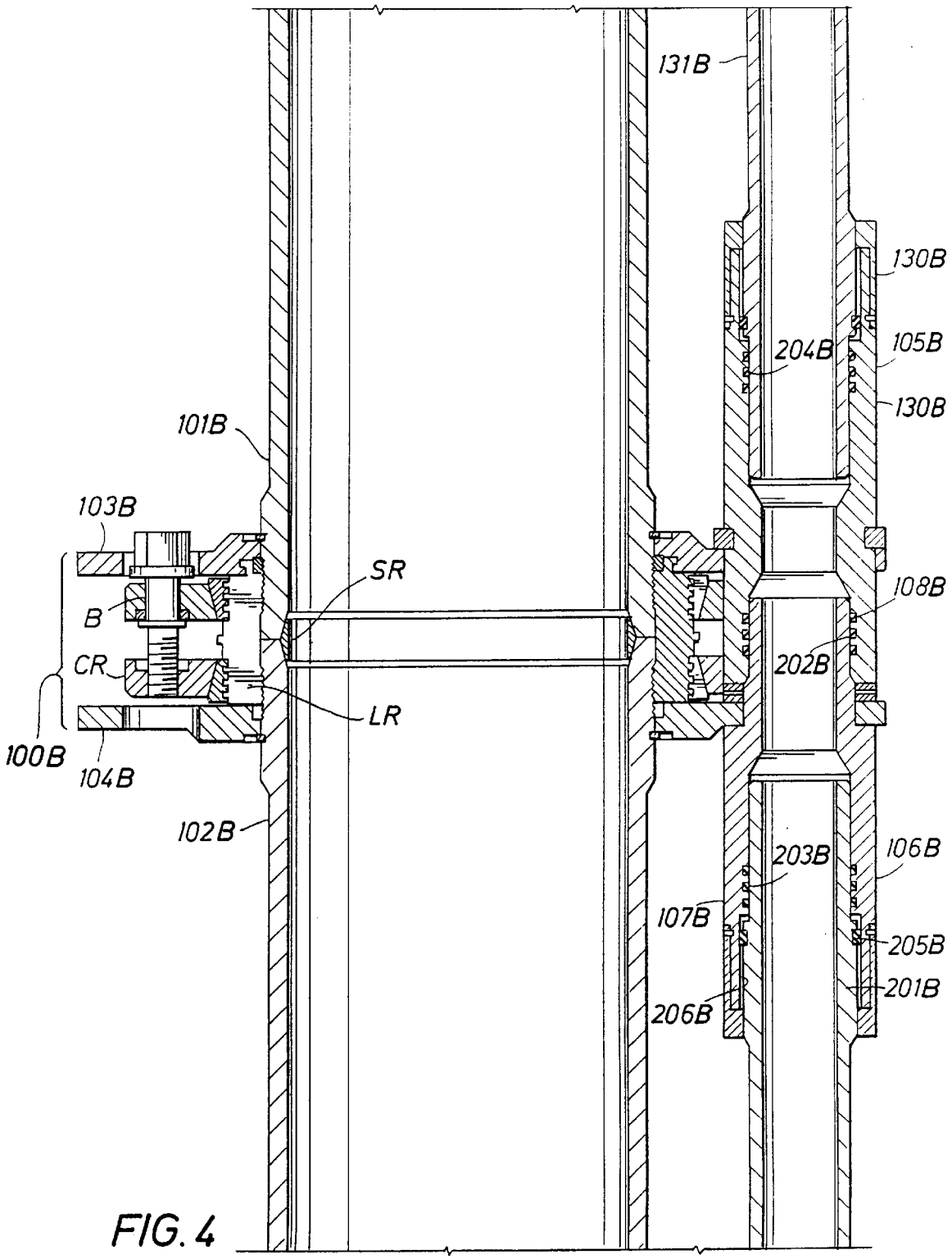

With reference now to the second embodiment of the invention shown in FIGS. 3 and 4, the upper and lower connectors and designated in their entirety by reference characters 100A and 100B, respectively, comprise upper and lower riser members 101A and 102A and upper and lower riser members 101B and 102B. The upper and lower riser members 101A and 102A of the upper connector are connected as by welding to the lower end of an upper riser pipe and to the upper end of the intermediate riser pipe, respectively, while the upper and lower riser members 101B and 102B of the lower connector are connected to the lower end of the intermediate riser pipe and the upper end of the lower riser pipe. More particularly, as in the first embodiment, the riser members of each connector are connected in end-to-end relation so as to in turn connect the riser pipes in coaxial relation, and a seal ring SR is sealably engaged between tapered surfaces at the adjacent ends of each riser member to form a smooth continuation of the bore through the connector, and thus through the riser.

A first or upper plate 103A is carried by the upper riser member and a second or lower plate 104A is carried by the lower riser member of the upper connector, and upper and lower plates 103B and 104B are similarly carried by the upper and lower riser members 101B and 102B of the second connector. As shown, these plates extend outwardly from the riser members so as to support conduits connected to the ends of the auxiliary line joints which extend along the sides of the riser pipes. Thus, the lower end of an upper conduit 105A of the upper connector is supported by the upper plate 103A of the upper connector, while the upper end of the lower conduit 106A thereof is supported by the plate 104A of the upper connector.

The lower end of the upper conduit 105B is supported by the upper plate 103B of the lower connector 100B, and the upper end of the lower conduit 106B of the lower connector 100B is supported by the plate 104B of the second connector.

More particularly, and as will be described in detail to follow, the adjacent ends of the conduits of each connector are adapted to move into sealed relation as the riser members of the respective connectors are moved into end-to-end relation.

As illustrated, the upper and lower riser members 101A and 102B of the upper and lower connectors of the second embodiment may be locked in end-to-end relation as described in connection with the first embodiment, so as to hold adjacent ends of the conduits of the auxiliary line held in sealed interfitting relation, by means of a split lock ring LR having upper and lower sets of teeth formed about its inner bore, respectively, and carried by the upper plate thereof for lowering therewith as well as radial movement with respect thereto. As previously described, the lock ring is carried for radial movement between a normally expanded position, in which its lower teeth are free to move downwardly over the lower riser member of each connector, and a contracted position, as shown in the drawings, in which the teeth are tightly engaged with matching grooves on the riser members of each coupling.

More particularly, and as also previously described, conical surfaces are formed about the upper and lower ends of the lock ring and are tapered toward one another, and surrounded by upper and lower cam rings CR having similarly tapered surfaces on their inner diameters for sliding over those of the lock ring so as to urge the lock ring inwardly to locking position, as the cam rings are moved inwardly toward one another, and to permit the lock ring to expand its normally assumed outer position when the cam rings are moved toward one another.

As also previously described, the cam rings are supported and adapted to be moved toward and away from one another by means of bolts B extending between them, with the upper ends of the bolts extending through and mounted on the upper cam ring with their lower ends connected to the lower cam rings by threads, whereby the heads of the bolts may be manipulated from above the upper plate of each connector in order to move the lower cam ring upwardly or downwardly with respect to the upper cam ring. and thus enable the lock ring to be moved between locking and unlocking position.

As illustrated in the second embodiment of the invention, the telescoping joint of each connector is located in both the upper and lower conduits, and thus, in the case of connector 100A, the upper conduit 105A, and the lower conduit 106A and, in the case of the lower connector 100B, between the lower conduit 106B of the lower connector and the upper end of the lower joint of the auxiliary line. The lower conduits of each of the upper and lower connectors 101A and 101B may be the same construction as those of the first embodiment. However, as compared with the connectors of the first embodiments, and as will be described to follow, the upper ends of each of the upper conduits 105A and 106A include an upper section and a lower section in which the upper section is sealably slidable, with the upper end of the upper section of the upper connector begin fixedly connected to the lower end of the upper riser pipe, and that of the lower connector being fixedly connected to the lower end of the intermediate riser pipe.

In any event, as in the case of the lower conduits, the upper and lower sections of each of the upper conduits are sealably slidable along diameters equal to the diameter of the sealing engagement of the adjacent ends of both conduits, whereby, as in the first embodiment, the telescoping joints are pressure balanced. As compared to the first embodiment, however, either section of each conduit may be restrained with damage to the other.

As shown, the lower telescoping joint of each connector includes an upper section sealably received slidable in the lower end of the upper conduit, and a lower section sealably slidable in the lower end of the upper section and having its lower end adapted to be welded to the upper end of the next lower joint of the auxiliary line. More particularly, the upper section 107A of the lower conduit 106A of the upper connector 100A is sealably received within the lower end 109A of the upper conduit 105A, and a lower section 201A thereof is sealably and slidably received within the lower end of the upper section 17A.

As previously described in connection with the first embodiment, the upper end 108A of the section 107A is sealably received within seal rings 202A of the lower end 109A of the upper conduit 105A along the same diameter as the upper end of the lower section 201A is sealably slidable within seal rings 203A in the lower end of the upper section 107A. More particularly, the upper section of the lower conduit is fixed in an axial direction with respect to the lower plate 104A, and the lower end 109A of upper conduit 105A is fixed in an axial direction with respect to the upper plate 103A. Consequently, with both plates held against vertical movement with respect to one another, when the connector is in locking position, the upper plate 103A is seated on an upper shoulder of the upper conduit, and held thereon by means of a lock screw, while an upper face of the upper section of the lower conduit is fixedly held against plate 104A by means of a lock screw on the lower plate by seated. Seal rings 202A thus form a static seal between the sections along a first diameter.

The lower section 201A is, however, free to slide vertically with respect to the upper section 107A so as to accommodate differential axial movement between the riser pipe and the auxiliary line. Since the diameters of the seal rings 202A and 203A are of the same diameters, the joint is pressure balanced.

A split ring 205A is mounted on the lower section beneath the seal rings 203A for sliding within a recess 206A formed on the inner diameter of the upper section 107A, thereby preventing separation of the two sections with respect to one another. As shown, the lower end of the upper section 107A may be formed in two parts to permit assembly.

As shown, the upper telescoping joint is a mirror image of the above described lower telescoping joint thereof. Thus, the upper and lower joints 105A and 105B include lower sections 130A and 130B, respectively, having lower ends in which the upper ends 108A and 108B of the upper and lower conduits 105A and 105B, respectively, are received, and upper sections 131A and 131B whose lower ends are sealably and slidably received in the upper ends of lower sections.

As previously described, with the upper ends of the sections 106A and 106B fixedly secured to the riser pipe joints above them, the sections 130A and 131A and 130B and 131B form telescoping joints at the upper and lower ends of each connector. More particularly, lower ends of the upper sections are slidably within seal rings 204A and 204B which are of the same diameter as seal rings 202A and 203B, thus providing pressure balance for both ends of each connector.

As indicated by similar reference characters, the sections of the conduits are retained within and held against rotation with respect to the lower sections in the same manner shown and described in connection with the upper and lower sections of the lower joints.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and within the cope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A connector for use in connecting the pipes of a riser and the tubular joints of an auxiliary line to one side of the riser in end-to-end relation, comprising:

an upper riser member having an upper end adapted to be connected to the lower end of an upper riser pipe and a lower end adapted to be connected to the upper end of a lower riser member, means for locking the upper and lower riser members in end-to-end relation, an upper conduit carried by the upper riser member in position to be connected to the lower end of an upper joint of the auxiliary line, a lower conduit carried by the lower riser member in position to be connected to the upper end of a lower joint of the auxiliary line, one of the conduits having a first section which has one upper end sealably engaged with the adjacent end of the other conduit along a first diameter and a second section having one end telescopically and sealably engaged with the opposite end of the first section along said first diameter for sliding movement axially with respect thereto, whereby the force due to pressure of fluid in the line acting on the first and second sections of said one conduit is balanced.

2. A connector as in claim 1, wherein the one end of the first section is received within the end of the other conduit, and the opposite end of the second section is received within the opposite end of the first section.

3. A connector as in claim 1, wherein the means for locking the riser members in end-to-end relation comprises shoulders about the riser members which are tapered toward one another, and a ring for engaging the shoulders to draw them, and thus the ends of the riser members, toward one another.

4. A connector as in claim 3, wherein the shoulders are formed on locking grooves, and the ring is split and has first and second axially spaced locking teeth on the inner side thereof which are carried by the upper riser member for radial movement between expanded positions in which the second teeth may be moved past the end of the lower riser member to dispose the first and second teeth opposite the first and second grooves, respectively, when said riser members are in end-to-end relation, and contracted positions in which the first and second teeth are interlocked with the first and second grooves, respectively, and said means for locking said riser members further includes cam means having cam shoulders thereabout which are slidable over follower surfaces about the outer side of the ring, and means for moving the cam means axially toward and away from a position to contract the ring into locking position.

5. A connector as in claim 1, including an upper support plate extending laterally of the upper riser member, and a lower support plate extending laterally of the lower riser member, the upper and lower conduits being mounted, respectively, on the upper and lower plates.

6. A connector as in claim 1, wherein the adjacent end of the other conduit is a first section which is telescopically and sealably engaged with a second section thereof along said first diameter.

7. An assembly of connectors for use in connecting the pipes of a riser and the tubular joints of an auxiliary line to one side of the riser in end-to-end relation, comprising:

an upper connector for connecting the lower ends of an upper riser pipe and upper joint of an auxiliary line to the upper ends of an intermediate riser pipe and an intermediate joint of the auxiliary line, respectively, a lower connector for connecting the lower ends of the intermediate riser pipe and intermediate joint of the auxiliary line, to the upper ends of a lower riser pipe and a lower joint, respectively, said upper connector comprising an upper riser member having an upper end adapted to be connected to the lower end of the upper riser pipe and a lower riser member having a lower end adapted to be connected to the upper end of an intermediate riser pipe, means for locking the upper and lower ends of the upper and lower riser members of the upper connector in end-to-end relation with one another, said lower connector comprising a lower riser member having an upper end adapted to be connected to the lower end of the intermediate riser pipe and a lower riser member having a lower end adapted to be connected to the upper end of the lower riser pipe, means for locking the upper and lower ends of the upper and lower riser members of the lower connector in end-to-end relation with one another, an upper conduit carried by the upper riser member of the upper connector in position to be connected to the lower end of the upper joint of the auxiliary line, a lower conduit carried by the upper riser member of the upper connector in position to be connected to the upper end of the intermediate joint of the auxiliary line, an upper conduit carried by the upper riser member of the lower connector in position to be connected to the lower end of the intermediate joint of the auxiliary line, and a lower conduit carried by the lower riser member of the lower connector in position to be connected to the upper end of the lower joint of the auxiliary line, adjacent ends of the upper and lower conduits of the upper connector as well as the adjacent ends of the upper and lower conduits of the lower connector being telescopically and sealably engaged with respect to one another along a first diameter to form flow paths between the upper and lower conduits of both connectors, and adjacent sections of the lower conduit of the upper connector and adjacent sections of the upper conduit of the lower connector having ends which are also being telescopically and sealably engaged along said first diameter to form a flow path there between upon connection of their opposite ends adjacent to adjacent ends of the auxiliary line.

8. An assembly as in claim 7, wherein each of the first and second locking means comprises shoulders about the riser members which are tapered toward one another, and a ring for engaging the shoulders to draw them, and thus the ends of the riser members, toward one another.

9. An assembly as in claim 8, wherein the shoulders are formed on locking grooves, the ring is split and has first and second axially spaced locking teeth on the inner side thereof which are carried by the upper most of the riser members for radial movement between expanded positions in which the second teeth may be moved past the end of the lower most riser member to dispose the first and second teeth opposite the first and second grooves, respectively, when said riser members are in end-to-end relation, and contracted positions in which the first and second teeth are interlocked with the first and second grooves, respectively, and said locking means includes cam means having cam slidable shoulders thereabout which are slidable over follower surfaces about the outer side of the ring, and means for moving the cam means axially toward and away from a position to contract the ring into locking position.

10. An assembly as in claim 7, including an upper support plate extending laterally of the upper most riser member of each of the connectors, and a lower support plate extending laterally of the lower most riser member of each of the connectors, the upper and lower conduits carried by the upper and lower riser members being mounted, respectively, on the upper and lower support plates.

* * * * *